US007464718B2

(12) United States Patent
McIntyre et al.

(10) Patent No.: US 7,464,718 B2
(45) Date of Patent: Dec. 16, 2008

(54) DISHWASHER LIQUID DELIVERY SYSTEMS

(75) Inventors: Carrie Lilley McIntyre, Mount Prospect, IL (US); Carlos Eduardo Sanchez, Miami, FL (US); Martin Mitchell Zentner, Prospect, KY (US); Jeffrey Neal Slotnick, Niskayuna, NY (US); Rodney James Barry, Louisville, KY (US); Joseph Duane Tobbe, Taylorsville, KY (US); Christopher Browning Harlow, Indianapolis, IN (US); Kittipat Vichyavichien, Bangkok (TH); John W. Pettengill, Brooklyn, NY (US)

(73) Assignee: General Electric Company, Schenectady, NY (US)

( * ) Notice: Subject to any disclaimer, the term of this patent is extended or adjusted under 35 U.S.C. 154(b) by 532 days.

(21) Appl. No.: 10/601,612

(22) Filed: Jun. 23, 2003

(65) Prior Publication Data

US 2005/0000551 A1 Jan. 6, 2005

(51) Int. Cl.
*B08B 3/02* (2006.01)

(52) U.S. Cl. ..... 134/94.1; 134/99.2

(58) Field of Classification Search ..... 68/17 R, 68/207, 12.18; 134/93, 94.1
See application file for complete search history.

(56) References Cited

U.S. PATENT DOCUMENTS

| | | | | | |
|---|---|---|---|---|---|
| 2,699,886 | A | * | 1/1955 | James, Jr. | 222/154 |
| 2,946,489 | A | * | 7/1960 | Brucken | 222/160 |
| 3,013,568 | A | * | 12/1961 | Getchell et al. | 134/58 R |
| 3,107,824 | A | * | 10/1963 | Perl | 222/207 |
| 3,127,067 | A | * | 3/1964 | Hall et al. | 222/630 |
| 3,289,896 | A | * | 12/1966 | Cushing | 222/154 |
| 3,402,853 | A | | 9/1968 | Perl | |
| 3,595,036 | A | * | 7/1971 | DePas | 68/12.15 |
| 3,608,514 | A | * | 9/1971 | Dunn | 116/228 |
| 3,749,288 | A | * | 7/1973 | Wade | 222/187 |
| 3,827,600 | A | * | 8/1974 | Janke | 222/651 |
| 3,856,058 | A | * | 12/1974 | Fackler | 141/18 |
| 4,149,654 | A | | 4/1979 | Nelson et al. | |
| 4,149,657 | A | | 4/1979 | Nelson et al. | |
| 4,213,338 | A | * | 7/1980 | Hardy | 73/299 |
| 4,488,666 | A | | 12/1984 | Herbst et al. | |
| 5,033,659 | A | | 7/1991 | Marks et al. | |
| 5,133,487 | A | | 7/1992 | Russi | |
| 5,211,188 | A | | 5/1993 | Kraus | |
| 5,396,914 | A | * | 3/1995 | McNair | 134/57 D |
| 5,823,390 | A | | 10/1998 | Muderlak et al. | |
| 5,884,808 | A | | 3/1999 | Muderlak et al. | |

(Continued)

FOREIGN PATENT DOCUMENTS

DE 24 07 544 * 8/1975

(Continued)

OTHER PUBLICATIONS

European Patent Office 0 430 366 Jun. 1991.*

*Primary Examiner*—Frankie L Stinson
(74) *Attorney, Agent, or Firm*—George L. Rideout, Esq.; Armstrong Teasdale LLP

(57) ABSTRACT

A system for dispensing a liquid, wherein the system includes a reservoir comprising a plurality of apertures disposed therein, and at least one dispenser in flow communication with the reservoir, the dispenser comprising a first and a second tube operatively coupled to the reservoir.

19 Claims, 11 Drawing Sheets

U.S. PATENT DOCUMENTS 6,012,613 A 1/2000 Chen
6,138,693 A * 10/2000 Matz ..... 134/57 D
6,293,428 B1 9/2001 Chen
6,338,351 B1 * 1/2002 Schrott ..... 134/99.2
6,453,917 B1 * 9/2002 Biechele ..... 134/99.2
6,616,401 B2 * 9/2003 Nakamura et al. ..... 414/811

FOREIGN PATENT DOCUMENTS

DE 34 42 194 * 5/1986
DE 10 00 378 * 7/1991

* cited by examiner

DISHWASHER LIQUID DELIVERY SYSTEMS

BACKGROUND OF THE INVENTION

This invention relates generally to dishwashers, and more particularly, to detergent dispensers for dishwashers.

At least some known dishwashers include a cabinet, a tub within the cabinet that defines an open sided wash chamber, and a door assembly that seals the open side of the wash chamber when the dishwasher is in use. Soiled dishes, glasses, utensils, food and beverage containers, etc. are loaded into the dishwasher tub through the open side of the wash chamber when the door is open, and after the door is closed, a dishwasher cycle may be executed to clean the items placed therein. The wash chamber includes a sump portion where washing fluid is pumped from a fluid circulation assembly through spray arm conduits to wash items loaded onto dishwasher racks in the wash chamber, and also where wash fluid is collected after being circulated throughout the wash chamber. The door assembly is attached to the dishwasher at a bottom end of the door and pivots about a hinge between fully open and fully closed positions.

Some known dishwashers include a detergent dispenser attached to an inner portion of the door assembly. The detergent dispenser includes a trough and a hinged lid or cover that closes the trough and prevents solid or powdered detergent therein from contacting moisture until a designated time in a wash cycle. At a point in time, the cover is opened and the detergent in the reservoir is released. To facilitate removal of all of the detergent from the dispenser, or to more quickly release detergent from the dispenser, a water spray jet may be directed into the trough to clear detergent from the dispenser trough.

However, the detergent dispenser is refilled between each dishwasher use by an operator, thereby adding additional steps and time. In addition, consistently and accurately filling the dispenser trough according to the selected wash cycle can be challenging. If too little detergent is added, wash cycle efficiency and effectiveness is decreased. If too much detergent is added, the additional detergent may be wasted or increase the risk of etching or spots.

BRIEF DESCRIPTION OF THE INVENTION

In one aspect, a system for dispensing a liquid is provided, the system includes a reservoir comprising a plurality of apertures disposed therein, and at least one dispenser in flow communication with the reservoir, the dispenser comprising a first and a second tube operatively coupled to said reservoir.

In another aspect, a system for dispensing a liquid detergent for a dishwasher door assembly is provided, wherein the system includes a reservoir coupled to the door assembly and comprising a housing including a first inlet aperture, a second inlet aperture, and an outlet aperture operatively disposed therein, a plurality of tubes in flow communication with the reservoir, and a dispenser comprising a plurality of check valves and a body, wherein the check valves are configured to direct the liquid detergent in one direction, and wherein the body includes a trough and a cover pivotably coupled to the body configured to dispense the liquid detergent.

In another aspect, a dishwasher is provided that includes a cabinet that includes a tub having a front opening and a door assembly forming a wash chamber, at least one system for dispensing a liquid in flow communication with said wash chamber. The system includes a reservoir coupled to the door assembly and comprising a housing including an inlet aperture and an outlet aperture operatively disposed therein, the inlet is configured to receive the liquid in the reservoir, the outlet aperture is configured to facilitate passage of the liquid from the reservoir, and a plurality of tubes in flow communication with said reservoir. The system also includes a dispenser in flow communication with said reservoir and said plurality of tubes that includes a check valve and a body, wherein the check valve configured to receive the liquid from the tube in a first direction only, and wherein the body includes a trough and a cover pivotably coupled to the body configured to dispense the liquid into the dishwasher.

DETAILED DESCRIPTION OF THE INVENTION

Figure 1:
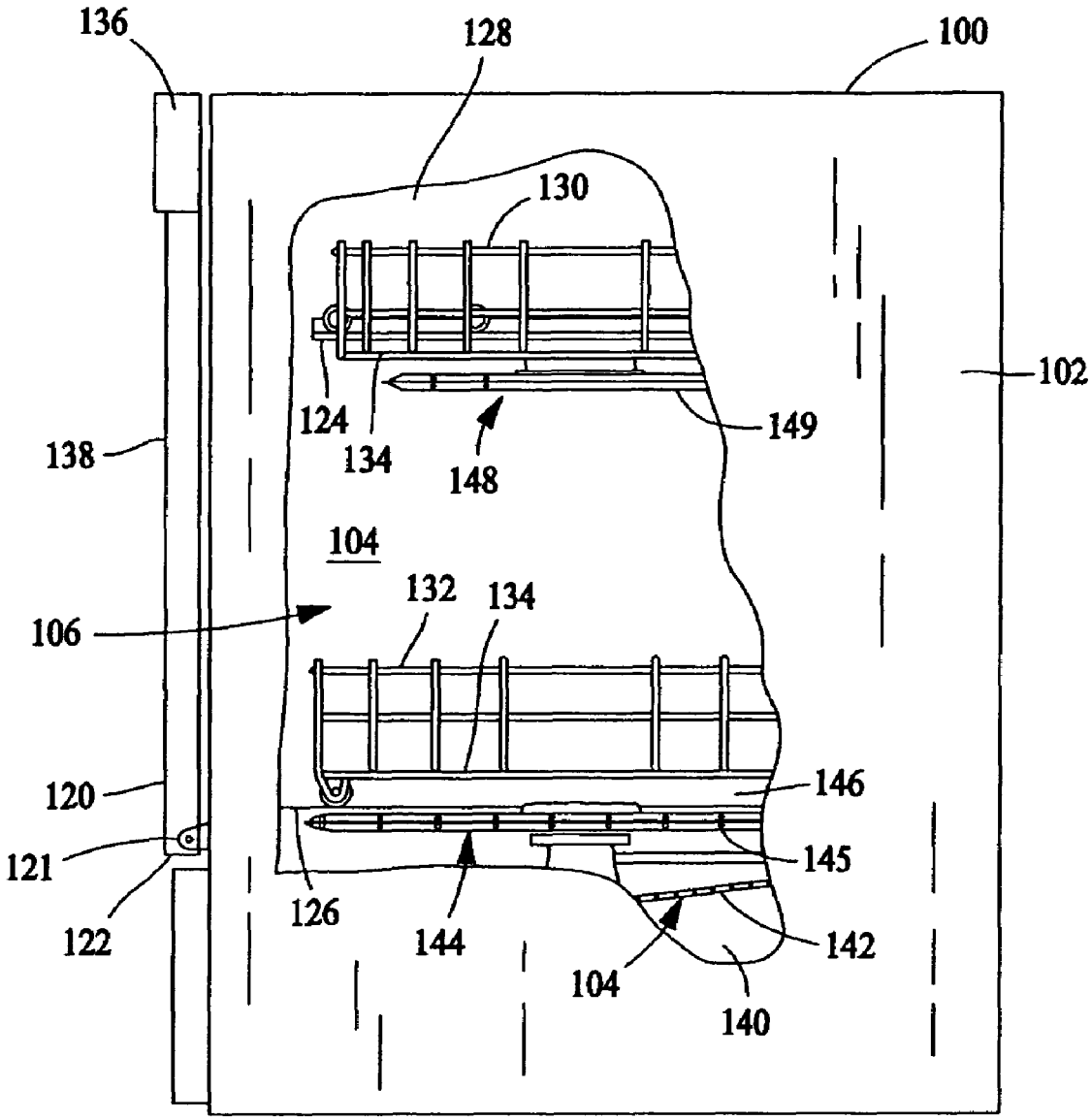
FIG. 1 is a side elevational view of an exemplary dishwasher system partially broken away.

FIG. 1 is a side elevational view of an exemplary domestic dishwasher system 100 partially broken away. It is contemplated, however, that the methods and apparatus herein described may be practiced in other types of dishwashers and dishwasher systems beyond dishwasher system 100 described and illustrated herein. Moreover, the methods and apparatus herein described may find utility in other applications wherein dispensers in wet environments are desirable. Accordingly, the following description is for illustrative purposes only, and the methods and apparatus herein described is in no way limited to use in a particular application, or to a particular type of appliance, such as, for example, dishwasher system 100.

Dishwasher 100 includes a cabinet 102 having a tub 104 therein and forming a wash chamber 106. Tub 104 includes a front opening (not shown in FIG. 1) and a door assembly 120 pivotally attached by a hinge 121 at a bottom 122 for movement between a normally closed vertical position (shown in FIG. 1) wherein wash chamber 106 is sealed shut for washing operation, and a horizontal open position (not shown) for loading and unloading of dishwasher contents. An upper guide rail 124 and a lower guide rail 126 are mounted on tub side walls 128 and accommodate an upper roller-equipped rack 130 and a lower roller-equipped racks 132. Each of upper and lower racks 130, 132 is fabricated from known materials into lattice structures including a plurality of elongate members 134, and each rack 130, 132 is adapted for movement between an extended loading position (not shown) in which the rack is substantially positioned outside wash chamber 106, and a retracted position (shown in FIG. 1) in which the rack is located inside wash chamber 106. A silverware basket (not shown) is removably attached to lower rack 132 for placement of silverware, utensils, and the like that are too small to be accommodated by upper and lower racks 130, 132.

A control panel (not shown in FIG. 1) is integrated into an escutcheon 136 that is mounted to door assembly 120, or in further and/or alternative embodiments, a plurality of control selectors, (e.g., buttons, switches or knobs) or control displays etc. may be mounted at a convenient location on an outer face 138 of door assembly 120. The control panel and associated selectors and displays are coupled to known control circuitry (not shown) and control mechanisms (not shown) for operating a fluid circulation assembly (not shown) that circulates water and dishwasher fluid in dishwasher tub 104. The fluid circulation assembly is located in a machinery compartment 140 located below a bottom sump portion 142 of tub 104. The construction and operation of the fluid circulation assembly is well within the purview of those in the art without detailed explanation, and further discussion of the fluid circulation assembly is therefore omitted.

A lower spray-arm-assembly 144 is rotatably mounted within a lower region 146 of wash chamber 106 and above tub sump portion 142 so as to rotate in relatively close proximity to lower rack 132. A mid-level spray-arm assembly 148 is located in an upper region of wash chamber 106 and is located in close proximity to upper rack 130 and at a sufficient height above lower rack 132 to accommodate a larger item, such as a dish or platter (not shown), that can be placed in lower rack 132 and washed in dishwasher system 100. In another embodiment, an upper spray arm assembly (not shown) is located above upper rack 130 at a sufficient height to accommodate a taller item that can be placed in upper rack 130, such as a glass (not shown) of a selected height.

Lower and mid-level spray-arm assemblies 144, 148 and the upper spray arm assembly are fed by the fluid circulation assembly, and each spray-arm assembly includes an arrangement of discharge ports or orifices 145, 149, respectively, for directing washing liquid onto dishes located in upper and lower racks 130, 132, respectively. The arrangement of the discharge ports 145 in at least lower spray-arm assembly 144 provides a rotational force by virtue of washing fluid flowing through the discharge ports 145. The resultant rotation of lower spray-arm assembly 144 provides coverage of dishes and other dishwasher contents with a washing spray. In various alternative embodiments, mid-level spray arm 148 and/or the upper spray arm are also rotatably mounted and configured to generate a swirling spray pattern above and below upper rack 130 when the fluid circulation assembly is activated and door assembly 120 is properly closed to seal wash chamber 106 for operation.

Figure 2:
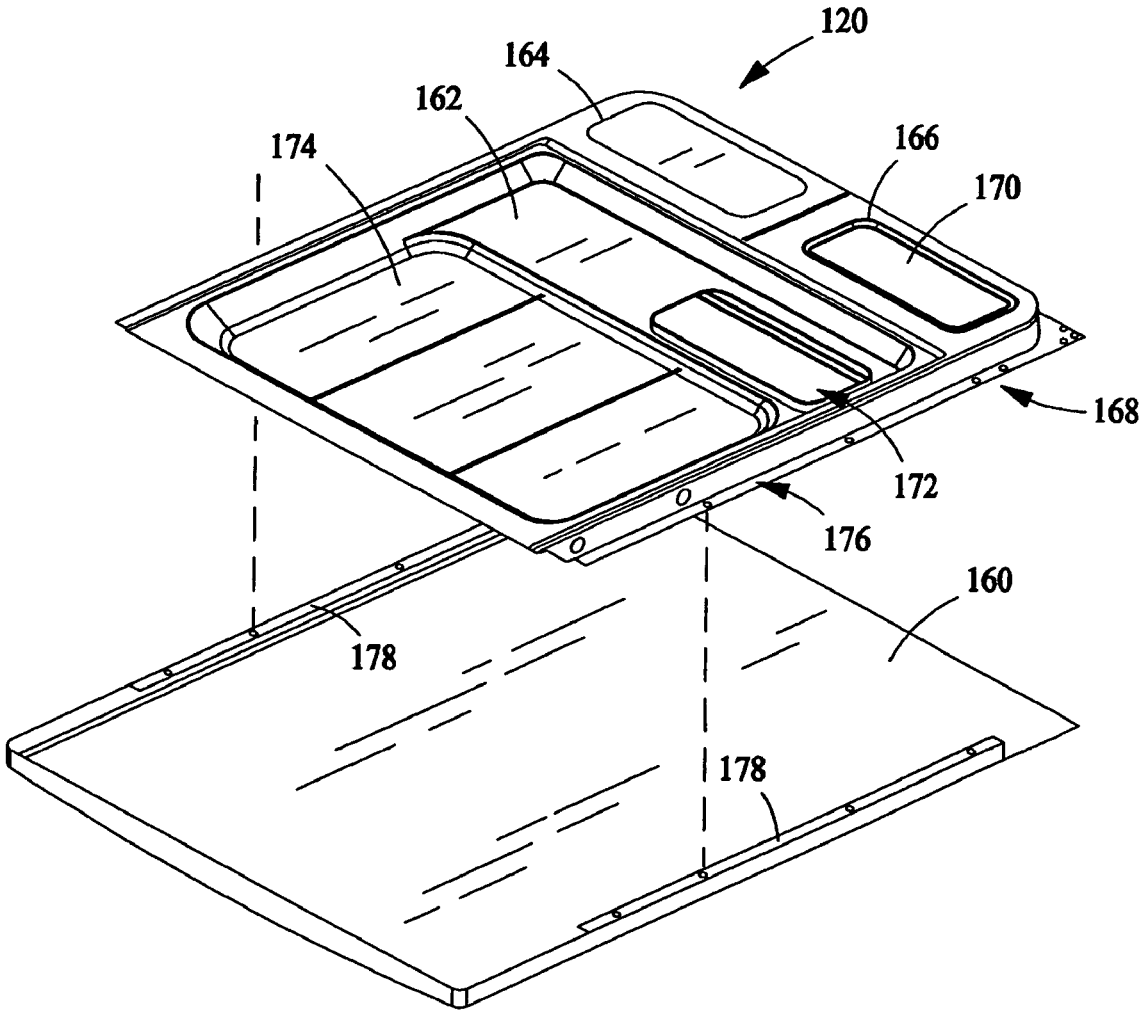
FIG. 2 is a perspective exploded view of a dishwasher door assembly including a bulk detergent delivery system for the dishwasher shown in FIG. 1.

FIG. 2 is an exploded perspective view of an exemplary dishwasher door assembly 120 that may be used, for example, with dishwasher 100 (shown in FIG. 1). Door assembly 120 includes an outer door panel 160 and an inner door panel 162.

Inner door panel 162, in an exemplary embodiment, includes an opening 164 therethrough for a vent assembly (not shown) and an opening 166 therethrough for receiving a liquid delivery system 168. Delivery system 168 includes a reservoir 170 and a dispenser 172 in flow communication with reservoir 170. Inner door panel 162 is contoured in a bottom region 174 for accommodating lower rack 132 (shown in FIG. 1) of dishwasher 100 (shown in FIG. 1). In one embodiment, inner door panel 162 is attached to outer door panel 160 via a plurality of attachment flanges 176 on an outer perimeter of inner door panel 162 that are fastened to a plurality of attachment flanges 178 in outer door panel 160. In one embodiment, an appliance control module (not shown) and a latch assembly (not shown) are further accommodated into door assembly 120 as those in the art will appreciate.

In general, reservoir 170, as explained further below, is filled with known dishwasher detergent (not shown in FIG. 2), such as commercially available liquid dishwasher detergent products. The liquid detergent flows through a hollow tube (not shown in FIG. 2) into detergent dispenser 172, as explained further below, until full. When dishwasher racks 130, 132 are loaded with items to be washed, door assembly 120 is closed, thereby sealing wash chamber 106 for operation of wash cycles. At an appropriate time in a wash cycle, dispenser 172 is opened to release its detergent contents into dishwasher wash chamber 106 (shown in FIG. 1) wherein the detergent is mixed with water to produce a cleansing fluid for circulation throughout wash chamber 106.

It is noted that exemplary inner door panel 162 and outer door panel 160 are intended for illustrative purposes only, and that that the herein described dispensers may be used with differently configured inner and/or outer door panels than illustrated. It is further contemplated that reservoir 170, and supporting mechanisms (such as a pump, etc.), as explained further below, may be located elsewhere relative to wash chamber 106 (shown in FIG. 1) of dishwasher system 100 (shown in FIG. 1) than in door assembly 122. In other words, reservoir 170 need not be attached to door assembly 120 and could be positioned elsewhere to accomplish at least some of the benefits of the methods and apparatus herein described.

Figure 3:
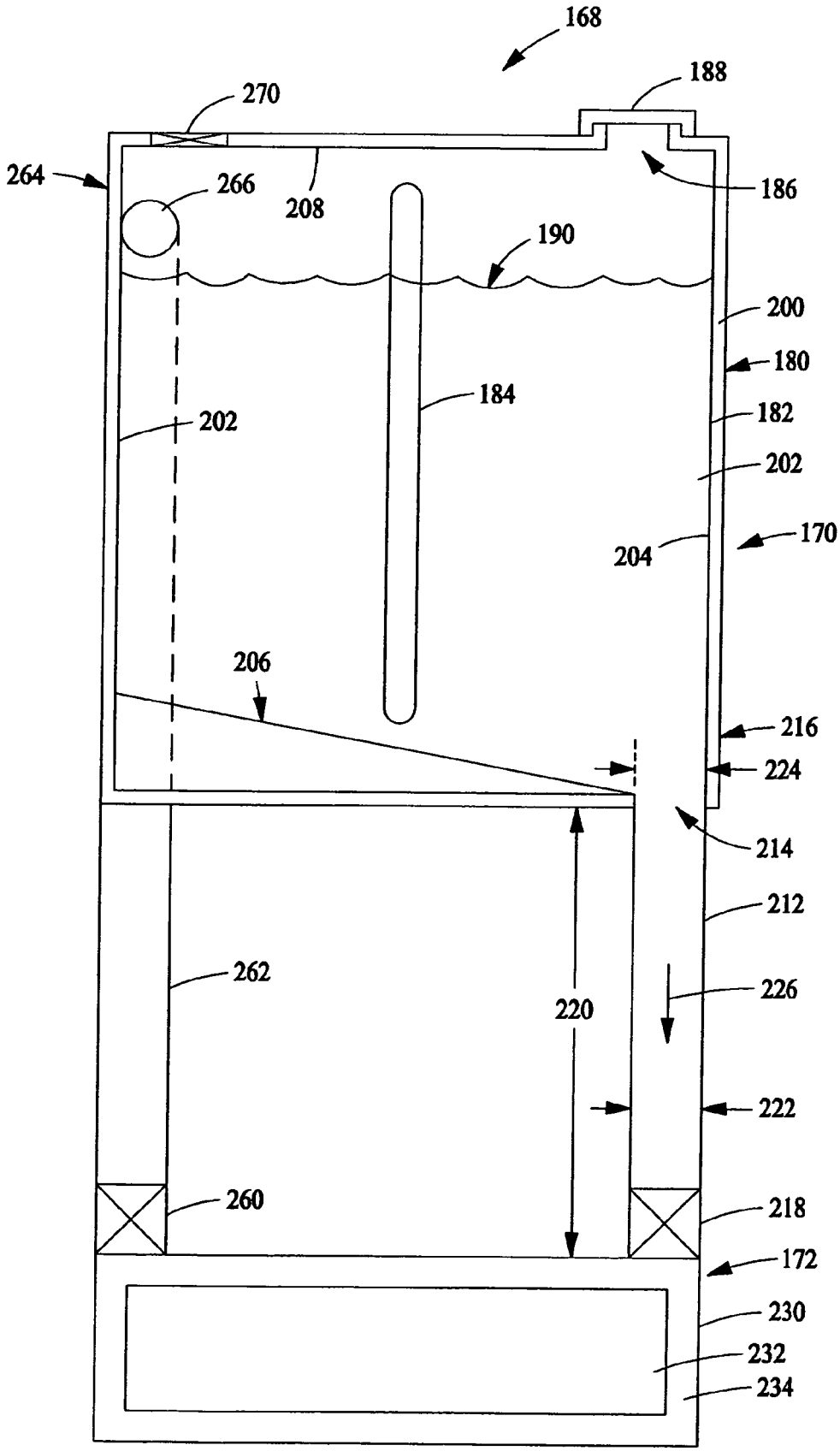
FIG. 3 is a front schematic illustration of the bulk detergent delivery system shown in FIG. 2.
Figure 4:
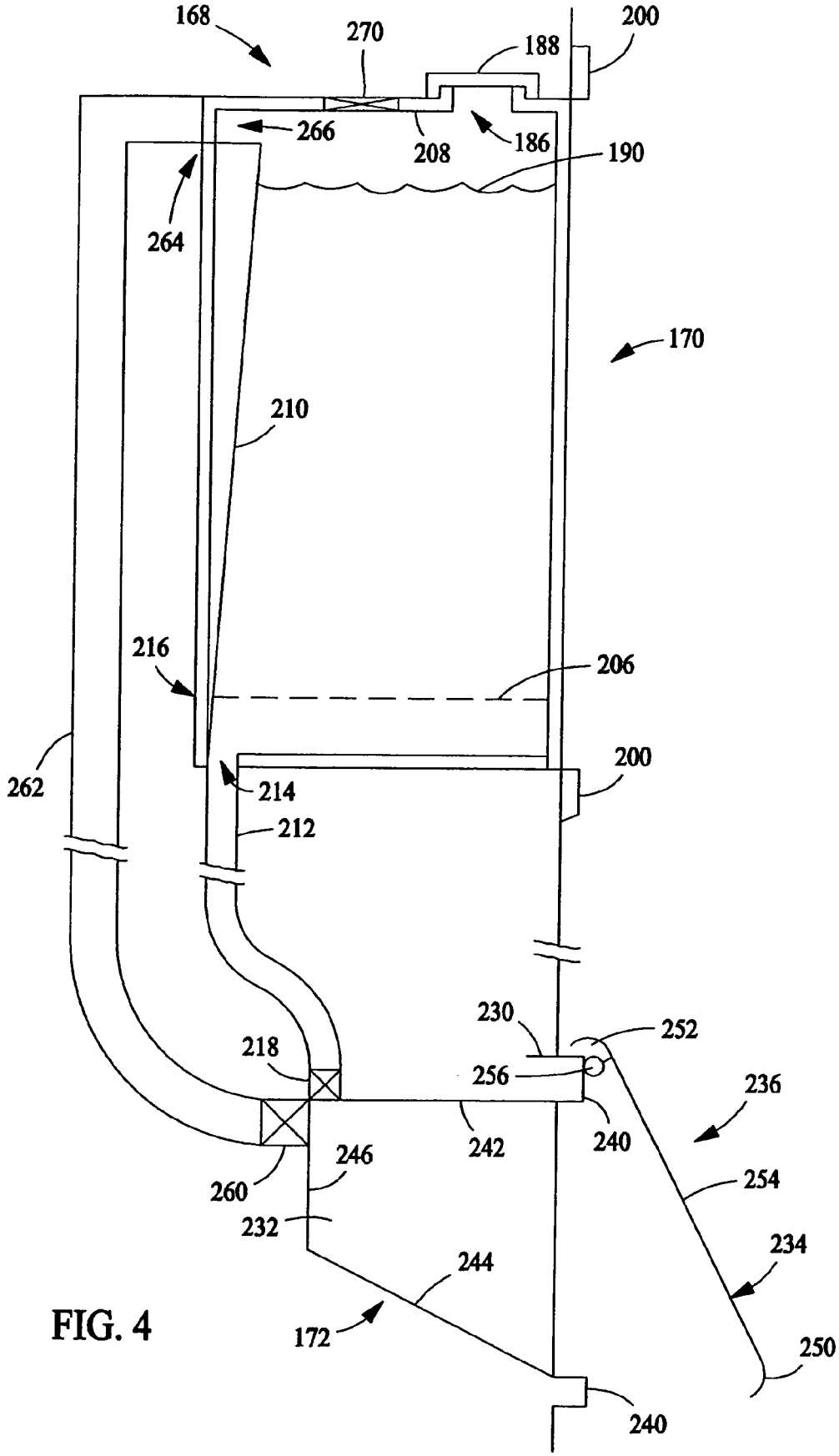
FIG. 4 is a cross-sectional schematic illustration of the bulk detergent delivery system shown in FIG. 2.

FIG. 3 is a front schematic view of a first embodiment of a bulk liquid delivery system 168, and FIG. 4 is a side cross-sectional schematic view bulk detergent delivery 168. Delivery system 168 includes a housing 180 and a hinged cover 182. In one embodiment, housing 180 and cover 182 are formed from a clear high-impact plastic, or other clear suitable material. In another embodiment, cover 180 includes a window 184 to enable a user to see inside housing 180 when cover 182 in a closed position.

Reservoir 170 is sized to fit inside housing 180. Reservoir 170 is, in one embodiment, integral with housing 180 and formed from a clear high-impact plastic or other clear suitable material. In another embodiment, reservoir 170 is sealed and pre-filled and removable cartridge that may be secured by a user, such as for example with a snap-fit engagement or other known locking or latching arrangement.

Reservoir 170 includes an inlet aperture 186 and an inlet cap 188. When door assembly 120 (shown in FIG. 2) is in a vertical position, reservoir 170 may be filled with a liquid 190 through aperture 186 and sealed with cap 188. In one embodiment, reservoir 170 may be filled with a plurality of liquids 190. In one embodiment, liquid 190 is a commercially available liquid dishwasher detergent. In another embodiment, liquid 190 is a commercially available liquid rinse agent.

A generally flat outer surface 200 surrounds reservoir 170 and includes a first side wall 202 extending from and substantially perpendicular to outer surface 200, a second side wall 204 extending from and substantially perpendicular to outer surface 200 opposite first side wall 202, and an angled bottom wall 206 extending from and substantially perpendicular to outer surface 200. Bottom wall 206 extends between respective ends of side walls 202, 204 and is angled downward from side wall 202 towards side wall 204. Reservoir 170 also includes a top wall 208 extending from and substantially perpendicular to outer surface 200 and an angled rear wall 210 extending between respective ends of bottom wall 206 and top wall 208 and is angled downwards from top wall 208 towards bottom wall 206. Reservoir 170 is sized and dimensioned to contain an adequate amount of liquid 190 for multiple wash cycles, and, when vertically oriented (as illustrated in FIGS. 3 and 4) bottom wall 206 and rear wall 210 are downwardly sloped toward an outlet aperture 214, thereby facilitating gravity assisted discharge of liquid 190 from reservoir 170.

Reservoir 170 is in flow communication with a first hollow tube 212 operatively attached to outlet aperture 214. Tube 212 extends from a lower portion 216 of housing 180 and directs liquid 190 from reservoir bottom wall 206 and reservoir rear wall 210 to a first check valve 218. Tube 212 has a length 220 and a diameter 222, wherein tube diameter 222 is equal to an outlet aperture diameter 224. Length 220, diameter 222, and diameter 224 are all variably sized relative to door assembly 120. In one embodiment, tube 212 is sized to receive a metered amount of liquid 190. Tube 212 may be formed from soft plastic or rubber such as silicone rubber or surgical-type rubber tubing. However, any suitable elastic or rubber material may be used.

Check valve 218 is in flow communication with metered dispenser 172. Check valve 218 is configured to allow liquid 190 flow in a first direction 226 only and prevents back flow into reservoir 196 when dispenser 172 is opened.

Dispenser 172 includes a body 230 defining a trough 232, and a cover 234 attached to body 230 to close trough 232 until a designated time in a dishwasher wash cycle. Cover 234 is selectively positionable between an open position 236 wherein liquid dishwasher detergent may be released from trough 232 while in the open position, and a closed position (shown in FIGS. 3 and 4) wherein trough 232 is substantially sealed to facilitate protecting contents of trough 232 from moisture until a designated release time. Cover 234 is securely closed by a user, such as, for example, with a snap-fit engagement or other known locking or latching arrangement.

Liquid 190 is added to reservoir 172 and flows gravitationally through tube 212 and valve 218 into trough 232. As such, it is not necessary to manually add liquid 190 directly in to dispenser 172 between wash cycles. As wash cycle dictates, cover 234 may be opened from the closed position to the open position to release liquid 190 from trough 232 with known mechanisms, including but not limited to cam operated mechanisms (not shown) familiar to those in the art and adapted to open the dispenser at a pre-selected time in a wash cycle.

In one embodiment, dispenser body 230 is fabricated from a known plastic material according to known techniques and includes a generally flat outer surface 240 surrounding trough 232. In one embodiment, trough 232 includes a first side wall 242 extending from and substantially perpendicular to outer surface 240, an inclined or angled side wall 244 extending from outer surface 240 opposite first side wall 242, and a flat rear wall 246 extending between respective ends of side walls 242, 244 and substantially parallel to outer surface 240. Trough 232 is sized and dimensioned to contain an adequate amount of liquid 190 for more than one wash cycle, and, when vertically oriented (as illustrated in FIGS. 3 and 4) lower side wall 244 is downwardly sloped toward dispenser outer surface 240, thereby facilitating gravity assisted discharge of liquid 190 from trough 232 when cover 234 is in the open position.

Cover 234, in one embodiment, is also fabricated from a known plastic material according to known techniques and includes opposite rounded ends 250, 252, a generally planar outer surface 254. Cover 234 is pivotally attached at one end via a hinge 256 coupled to dispenser body 230 such that cover 234 pivots wash cycle setting. In one embodiment, pump 300 is spring-loaded pump, and reservoir 170 is a pre-filled removable reservoir filled with liquid 190. In another embodiment, pump 300 is in flow communication with dispenser 172.

Figure 7:
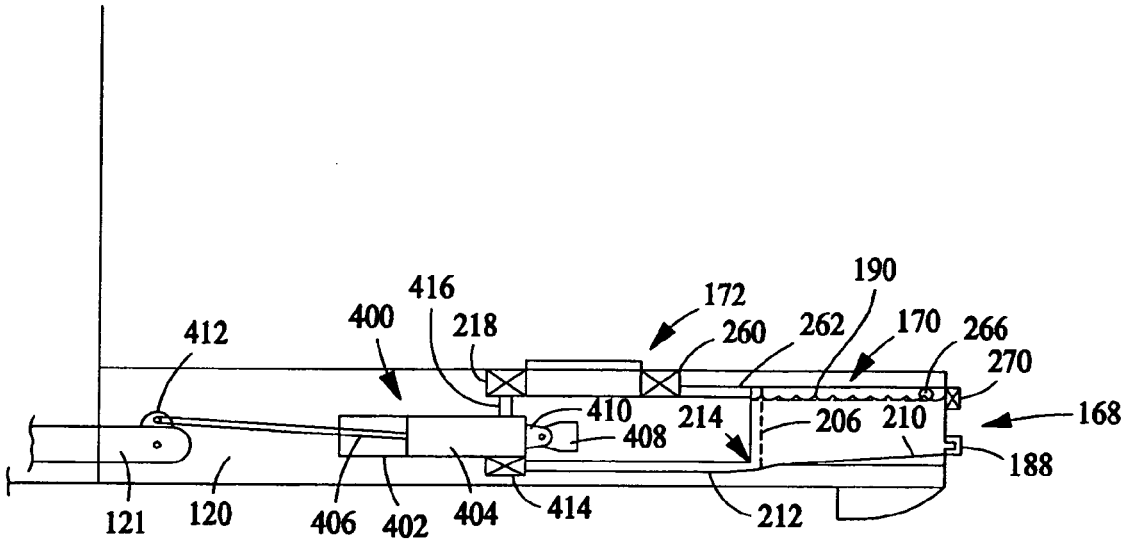
FIG. 7 is a side schematic illustration of the liquid delivery system disposed in a dishwasher door assembly in an open position.
Figure 8:
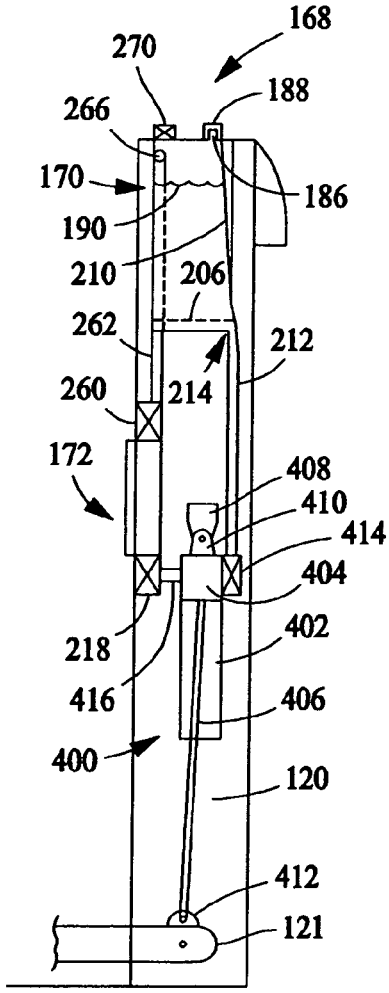
FIG. 8 is a side schematic illustration of the liquid delivery system disposed in a dishwasher door assembly in a closed position.

FIG. 7 is a side schematic illustration of liquid delivery system 168 disposed in dishwasher door assembly 120 in the open position. FIG. 8 is a side schematic illustration of liquid delivery system 168 disposed in dishwasher door assembly 120 in the closed position. System 168 includes a piston-driven pump 400 in flow communication with reservoir 170 and dispenser 172 and positioned between outlet aperture 214 and check valve 218 along tube 212.

Piston pump 400 includes a housing 402 that includes a cavity 404 and a piston 406 disposed therein. It is appreciated that housing 402, cavity 404, and piston 406 are variably sized depending on the dishwasher capacity. Housing 402 is pivotably coupled to a door member 408 of dishwasher door 120 by a first hinge 410. Piston 406 is pivotably coupled to door member 121 by a second hinge 412. Pump 400 is actuated by opening and closing door 120.

In operation, cap 188 is removed and reservoir 170 is filled through inlet aperture 186 with liquid 190 while door 120 is ajar, and substantially vertically upright. As reservoir 170 is filled, gravity feeds liquid 190 into tube 212 until reservoir 170 is full. Cap 188 is replaced after reservoir 170 is full, and door 120 may then be opened substantially horizontally such that items to be washed may be disposed in the wash chamber 106 (shown in FIG. 1). As door 120 is opened, piston 406 withdraws from housing 402 drawing liquid 190 through a check valve 414 into cavity 404. Check valve 414 prevents back flow of liquid 190 into reservoir 170. As door 120 is returned to the closed position, piston 406 extends into housing 402 forcing liquid 190 out of cavity 404 through a hollow tube 416 and check valve 218 of dispenser 172. Check valve 218 prevents back flow of liquid 190 into pump 400.

In the event door 120 is opened and closed several times prior to initiating the wash cycle, liquid 190 may continue to pump in to dispenser 172. about hinge 256 between an open position (shown in FIG. 4) during a wash cycle and a closed position (shown in FIG. 3) after a wash cycle is complete.

Dispenser 172 is in flow communication with a second check valve 260. Check valve 260 is in flow communication with a second hollow tube 262. Tube 262 extends to an upper portion 264 of housing 180 and is in flow communication with reservoir 170 via an overflow aperture 266. Check valve 260 is configured to allow dispenser 172 to be filled with liquid 190. Additionally, liquid 190 can not flow out of reservoir 170 via tube 262 to dispenser 172. A third check valve 270 is coupled to upper portion 264 of housing 180. Check valve 270 is configured to vent air during refilling of reservoir 170.

Figure 5:
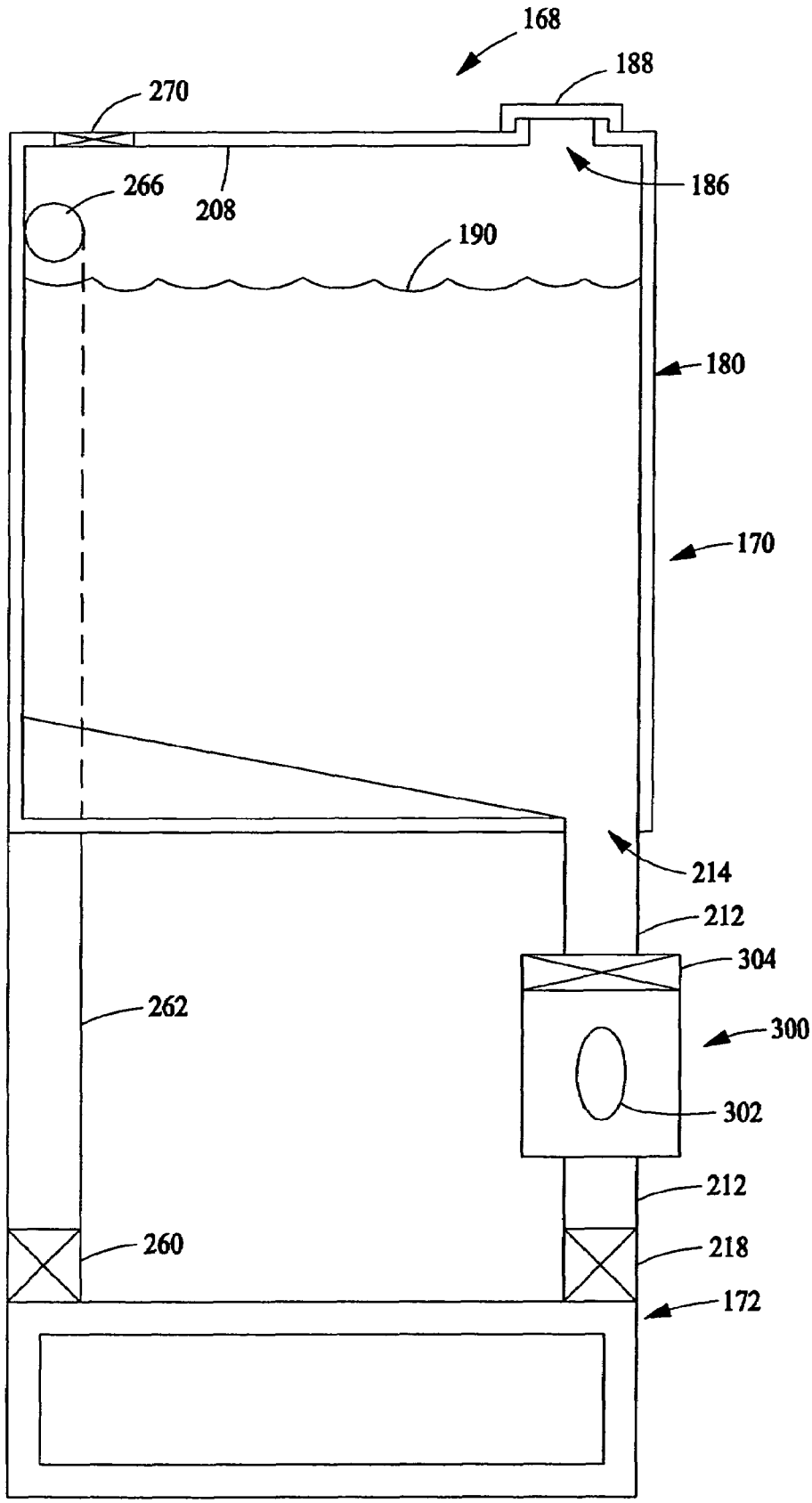
FIG. 5 is a front schematic illustration of the liquid delivery system including a mechanical pump.

FIG. 5 is another embodiment of the liquid delivery system 168 including a bulb-type priming pump 300. Pump 300 includes a member 302 requiring manual force to feed liquid 190 from reservoir 170 into dispenser port 172. Pump 300 is positioned inside dishwasher door assembly 120 (shown in FIG. 2) and is configured to have bulb member 302 user accessible from dishwasher door inner surface 162 (shown in FIG. 2). In another embodiment, pump 300 is a lever-type pump and member 302 is a lever. Pump 300 is in flow communication with reservoir 170 and dispenser 172 and positioned between aperture 214 and check valve 218 along tube 212. Check valve 218 prevents back flow into pump 300. Pump 300 includes a check valve 304 configured to prevent back flow of liquid 190 into reservoir 170 during pump 300 operation.

Figure 6:
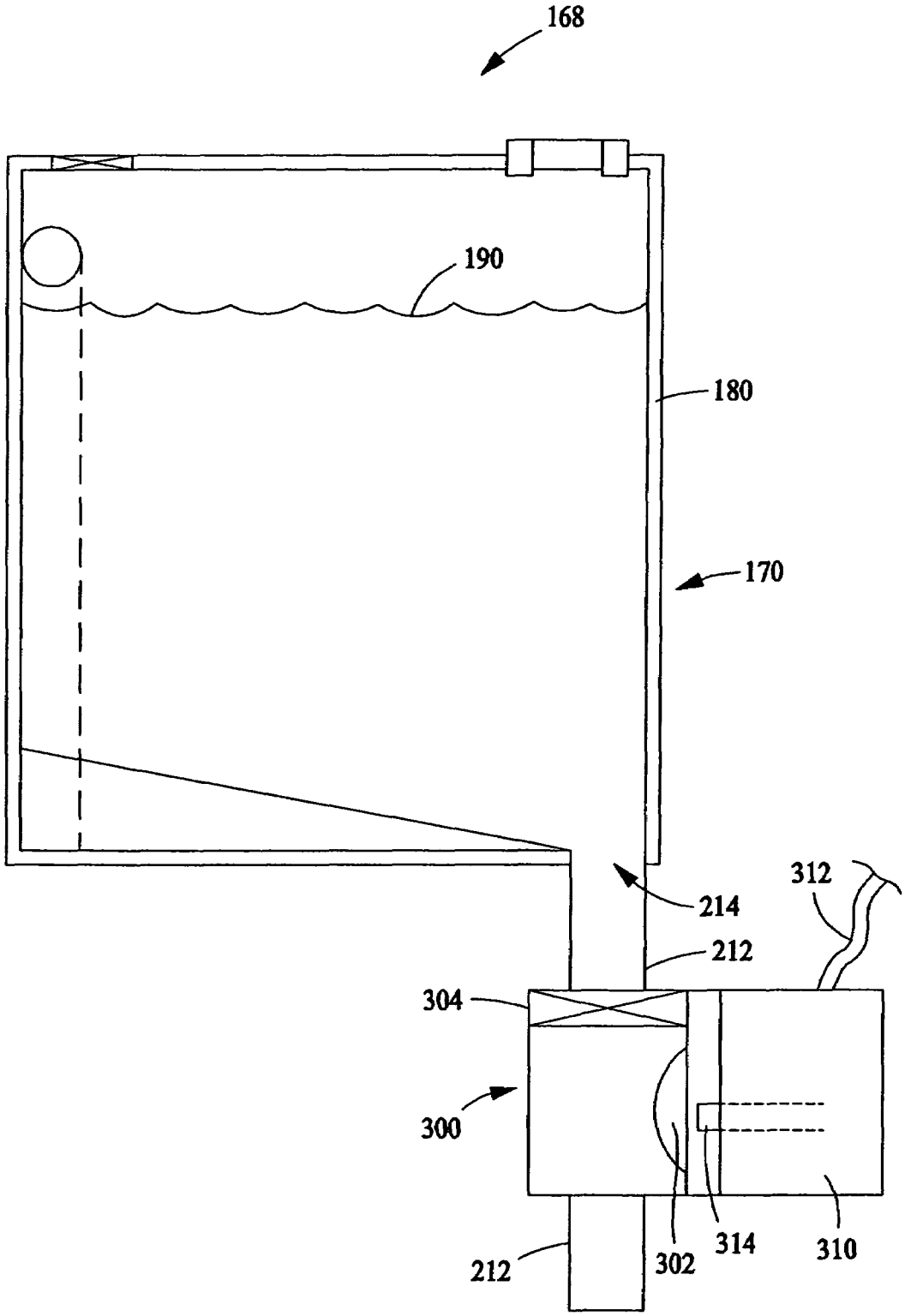
FIG. 6 is a front schematic illustration of the liquid delivery system including a electromechanical pump.

FIG. 6 is another embodiment of liquid delivery system 168 including another embodiment of pump 300. Pump 300 includes a mechanical member 302 such as a bulb described above, but may be a spring-loaded or piston-driven bulb. Pump 300 is mechanically coupled to a solenoid 310. Solenoid 310 is positioned inside dishwasher door assembly 120 (shown in FIG. 2) and is electrically coupled to the dishwasher main control (not shown) by wires 312. When solenoid 310 is actuated a mechanical finger 314 impacts pump member 302 and a pre-determined amount of liquid 190 is fed into wash chamber 106 (shown in FIG. 1). It is appreciated that the amount of liquid 190 can be varied depending on the Once dispenser 172 is full, excess liquid 190 is forced via check valve 260 and tube 262 through overflow aperture 266 back into reservoir 170.

Figure 9:
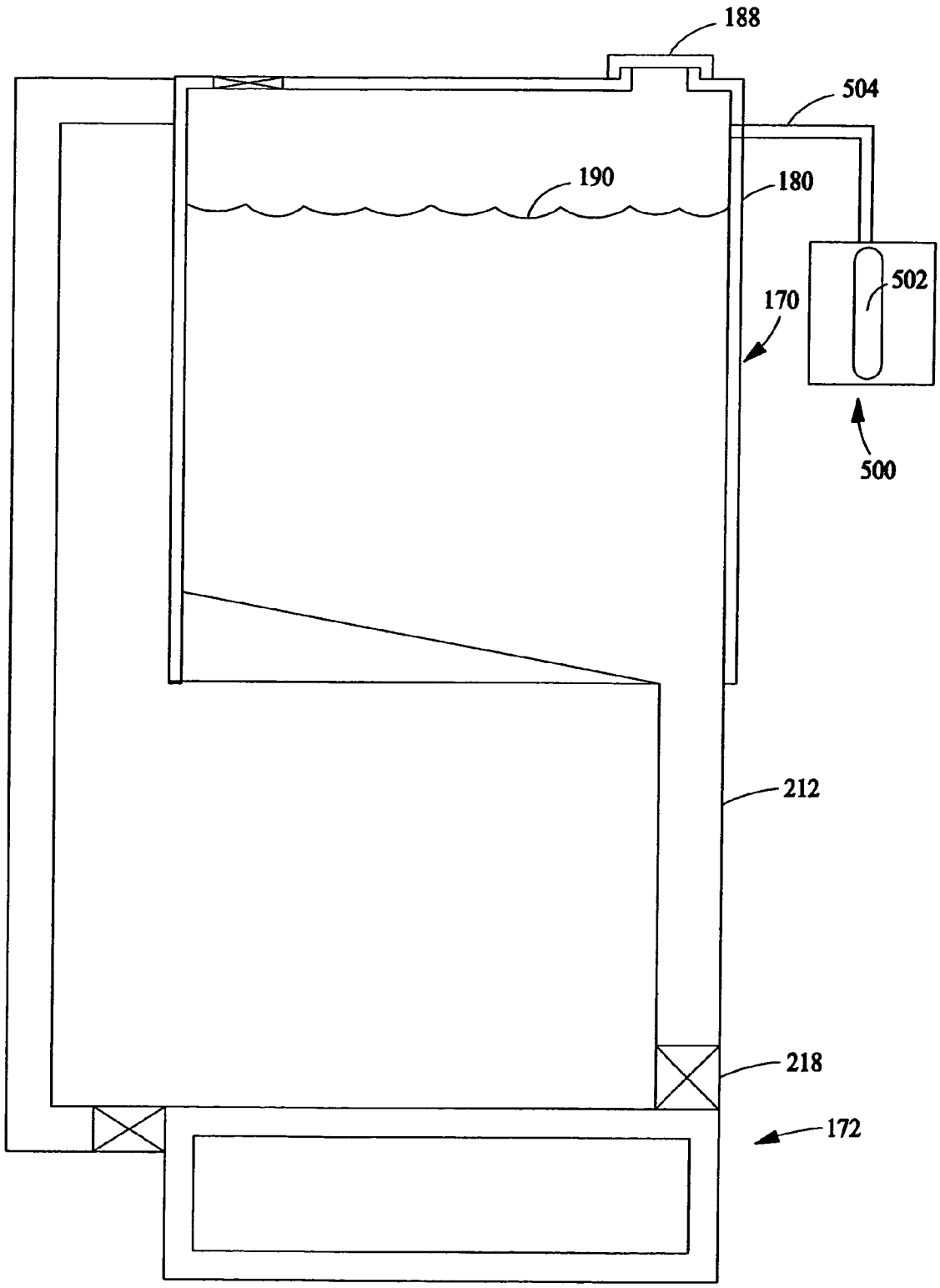
FIG. 9 is a front schematic illustration of the liquid dispensing system including a compressed air pressure generator.
Figure 10:
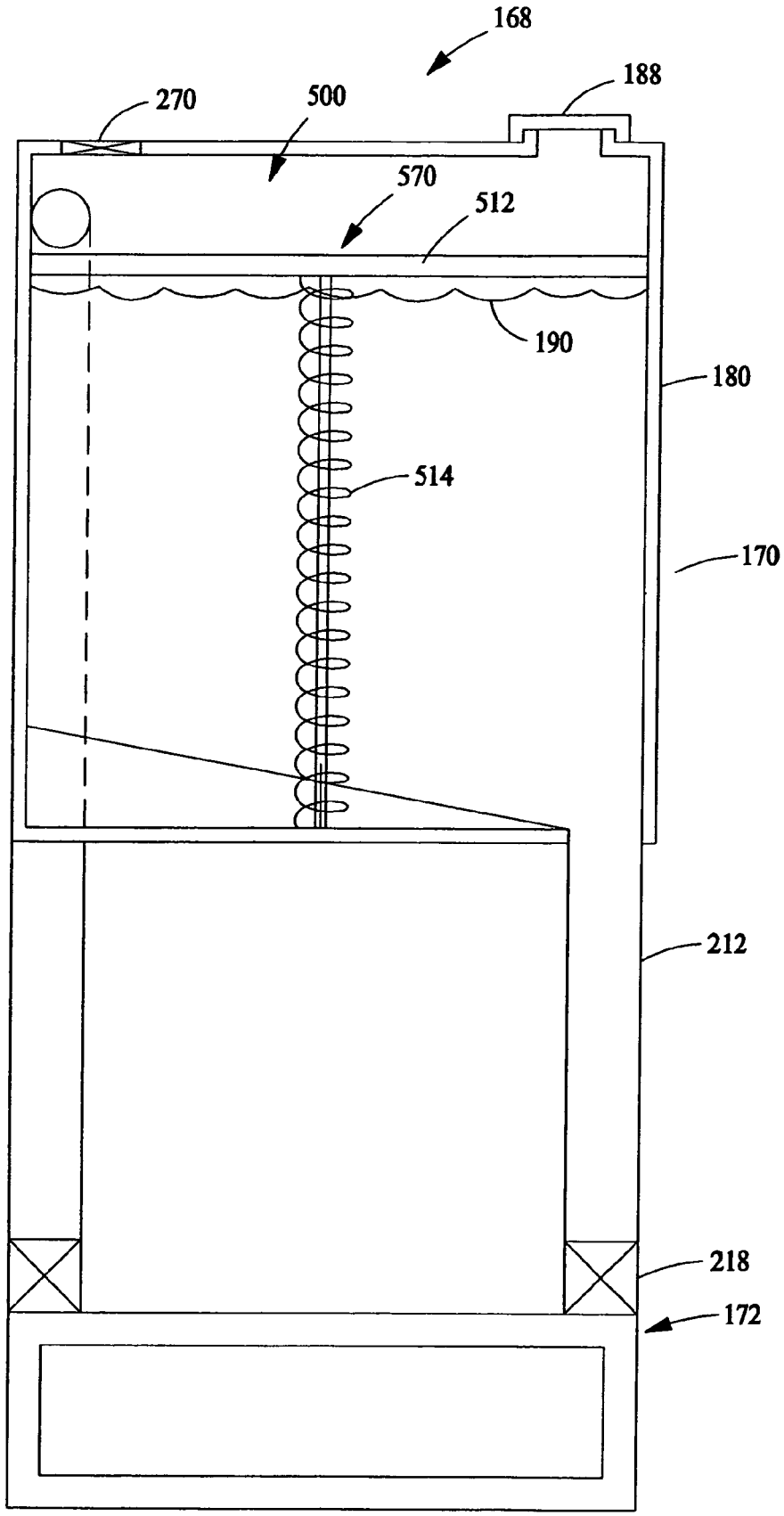
FIG. 10 is a front schematic illustration of the liquid dispensing system including a sealed, spring-loaded actuated diaphragm pressure generator.
Figure 11:
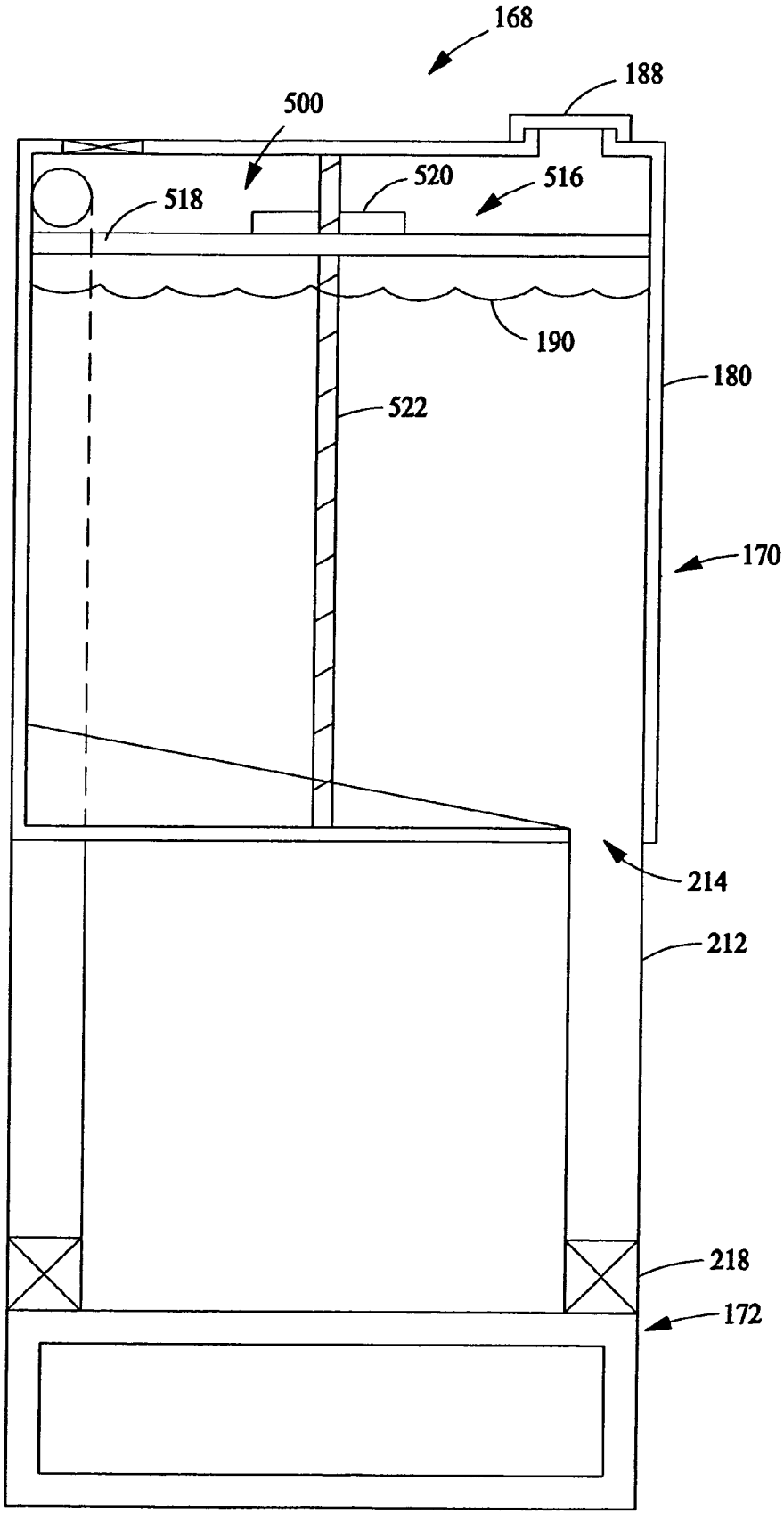
FIG. 11 is a front schematic illustration of the liquid dispensing system including a sealed, screw-driven diaphragm pressure generator.

FIGS. 9-11 are additional embodiments of liquid dispensing system 168 including reservoir 170, dispenser 172, and a pressure generator 500. In FIG. 9, pressure generator 500 is compressed air from a tank or cartridge 502. In an alternate embodiment, pressure generator 500 is compressed air from a known electromechanical pump, such as a piston-driven pump. Pressure generator 500 is operatively connected to reservoir 170 via a hollow tube 504 through housing 180. In operation, reservoir 170 is filled with liquid 190 and sealed by cap 188. Pressure generator 500 is actuated and air is pumped in to reservoir 170 and liquid 190 is forced through tube 212 to dispenser 172. Pressure generator 500 is in communication with a dishwasher main control (not shown) such that pressure is regulated and length of actuation is based on selected wash cycle.

In FIG. 10, pressure generator 500 is a sealed, spring-loaded actuated diaphragm 510. Diaphragm 510 includes a piston 512 and a biasing member 514 in mechanical communication with liquid 190. In operation, reservoir 170 is filled with liquid 190 and sealed by cap 188. Biasing member 514 drives piston 512 downward such that liquid 190 is forced in to dispenser 172. Pressure generator 500 is in communication with dishwasher main control (not shown) such that pressure is regulated based on selected wash cycle.

In FIG. 11, pressure generator 500 is a sealed, power screw compressed diaphragm 516. Diaphragm 516 includes a piston 518 fixedly coupled to a piston nut 520. Nut 520 is rotatably coupled to a screw member 522. In operation, reservoir 170 is filled with liquid 190 and sealed by cap 188. Screw member 522 is actuated and piston 518 is driven downwards such that liquid 190 is forced through tube 212 to dispenser 172.

Figure 12:
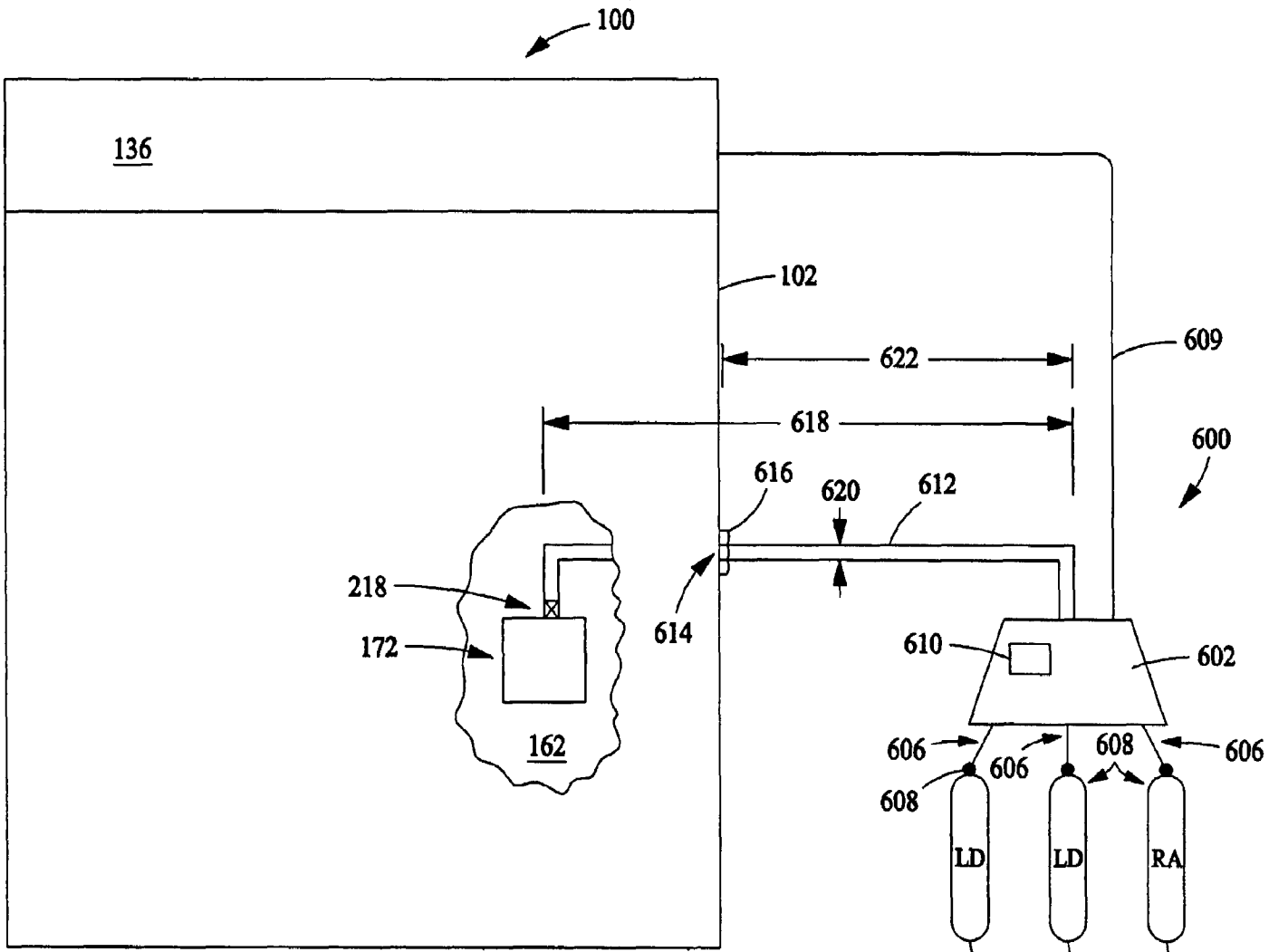
FIG. 12 is a front schematic illustration of a remote liquid dispensing system.

FIG. 12 is a front schematic illustration of remote liquid dispensing system 600 including a pump mechanism 602 and a plurality of liquid cartridges 604. In one embodiment, cartridges 604 are filled with liquid detergents and/or liquid rinse agents. In another embodiment, two of the cartridges 604 are filled with different liquid detergents and the remaining cartridge 604 is filled with a liquid rinse agent. Cartridges 604 are interchangeable and as such the user may select a combination of cartridges corresponding to the items washed or wash cycle chosen. In one embodiment, the cartridges are fabricated from a known clear plastic material according to known techniques in order to facilitate viewing amount of liquid remaining in cartridges after use. In another embodiment, cartridges may be refilled after use. As such, it is not necessary to add detergent to the dispenser between wash cycles, rather cartridges 604 are checked periodically but less than after each wash cycle.

Cartridges 604 are in fluid communication with pump mechanism 602 via a plurality of hollow tubes 606 and connectors 608 such that cartridges 604 may be attached and detached. In one embodiment, connectors 608 include a shut off valve (not shown) such that cartridges 604 may be removed with out spillage of residual liquid in tubes 606. In another embodiment, tubes 606 extend inside cartridges 604 to a bottom portion of cartridge 604.

Pump 602 is a known electromechanical liquid pump, including but not limited to cam-operated mechanisms (not shown), piston-operated mechanisms (not shown), and compressed air mechanisms (not shown). Pump 602 is in electrical communication 609 with dishwasher main control (not shown) such that pump 602 is regulated based on a user selected wash cycle. In an alternative embodiment, pump 602 is manually controlled by a pump control panel 610.

Pump 602 is in fluid communication with dispenser 172 via a hollow tube 612 and check valve 218. Tube 612 is disposed through an aperture 614 in dishwasher cabinet 102 and fitted with a grommet 616. Tube 612 has a length 618 and a diameter 620, wherein tube diameter 620 is sized to fit cavity aperture 614. Length 618, diameter 620, and aperture 614 are all variably sized relative to dishwasher 100 as well as a distance 622 between dishwasher 100 and dispensing system 600.

In one embodiment, dispensing system 600 is mounted inside and underneath an adjacent kitchen cabinet (not shown), although it is appreciated that other relative orientations of dispensing system 600 may be employed in alternative embodiments.

A reliable bulk detergent dispensing system is therefore provided that may be implemented with reduced time and steps in comparison to conventional dishwasher systems.

While the invention has been described in terms of various specific embodiments, those skilled in the art will recognize that the invention can be practiced with modification within the spirit and scope of the claims.

What is claimed is:

1. A system for dispensing a liquid, said system comprising:

a reservoir comprising a plurality of apertures disposed therein; and a dispenser in flow communication with said reservoir, said dispenser comprising a first tube coupled with respect to a first aperture of said plurality of apertures and providing flow communication between said reservoir and said dispenser to introduce liquid into said dispenser, and a second tube coupled with respect to a second aperture of said plurality of apertures and providing flow communication between said dispenser and said reservoir to introduce overflow liquid from said dispenser into said reservoir, said dispenser further comprising a body comprising a trough and a cover pivotably coupled to said body, said trough stationary with respect to said body and configured to dispense liquid when said cover is in an open position.

2. A system in according with claim 1 further comprising a first check valve in flow communication with said first tube.

3. A system in accordance with claim 2 further comprising a second check valve in flow communication with said second tube.

4. A system in accordance with claim 1 wherein said reservoir is coupled to a pressure generator selected from the group consisting of an air compressor, an air cartridge, a spring-loaded, sealed diaphragm, and a screw-driven, sealed diaphragm.

5. A system in accordance with claim 1 further comprising a pump in flow communication with said reservoir and said dispenser, said pump is a pump selected from the group consisting of a mechanical pump, an electromechanical pump, and an electric pump.

6. A system in accordance with claim 1 wherein said reservoir is filled with a liquid, said liquid is a liquid selected from the group consisting of a liquid detergent and a rinse agent.

7. A system in accordance with claim 1 wherein said reservoir further comprises a cartridge removably coupled to said reservoir, said cartridge filled with at least one liquid.

8. A system for dispensing a liquid, said system comprising:

a reservoir comprising a plurality of apertures disposed therein; and a dispenser in flow communication with said reservoir, said dispenser comprising a first tube and a second tube operatively coupled to said reservoir, said dispenser further comprising a body comprising a trough and a cover pivotably coupled to said body, said trough configured to dispense liquid when said cover is in an open position, said reservoir further comprising a first inlet aperture disposed therein and configured to receive the liquid in said reservoir, a second inlet disposed therein and configured to receive an overflow liquid from said second tube, and an outlet aperture disposed therein and configured to deliver the liquid by gravity to said dispenser through said first tube.

9. A system for dispensing a liquid detergent for a dishwasher door assembly, said system comprising:

a reservoir coupled to the door assembly and comprising a housing including a first inlet aperture, a second inlet aperture, and an outlet aperture operatively disposed therein;

a plurality of tubes in flow communication with said reservoir; and a dispenser comprising a plurality of check valves and a body, said check valves configured to direct the liquid detergent in one direction, said body comprising a trough and cover pivotably coupled to said body configured to dispense the liquid detergent.

10. A system in accordance with claim 9 further comprising a pump comprising a check valve in flow communication with said reservoir and said dispenser, said pump is a pump selected from the group consisting of a bulb actuated mechanical pump, a lever actuated mechanical pump, and a solenoid-driven electric pump.

11. A system in accordance with claim 10 wherein said pump is a piston-type pump, said pump pivotably coupled to a door assembly hinge such that the liquid detergent is pumped from said reservoir into said dispenser when the door assembly is moved between a closed position and an open position.

12. A system in accordance with claim 9 wherein said reservoir further comprises a pressure generator selected from the group consisting of an air pump, a spring-loaded piston, and a screw-driven piston.

13. A system in accordance with claim 9 wherein said reservoir further comprises a plurality of angled walls and a check valve mounted to an upper portion of said reservoir, said angled walls configured to slope towards said reservoir outlet aperture, said check valve configured to vent air during filling of said reservoir with a liquid.

14. A system in accordance with claim 9 wherein said reservoir comprises a reservoir assembly coupled to a pump assembly, said pump assembly and said reservoir assembly positioned outside said door assembly.

15. A dishwasher comprising:

a cabinet comprising a tub having a front opening and a door assembly forming a wash chamber; and at least one system for dispensing a liquid, said at least one system in flow communication with said wash chamber, said system comprising:

a reservoir coupled to said door assembly and comprising a housing including an inlet aperture and an outlet aperture operatively disposed therein, said inlet aperture configured to receive the liquid in said reservoir, said outlet aperture configured to facilitate passage of the liquid from said reservoir;

a plurality of tubes in flow communication with said reservoir; and a dispenser in flow communication with said reservoir and said plurality of tubes, said dispenser comprising a check valve and a body, said check valve configured to receive the liquid from one of said plurality of tubes in a first direction only, said body comprising a trough and a cover pivotably coupled to said body, said trough configured to dispense the liquid into said dishwasher.

16. A dishwasher in accordance with claim 15 further comprising a pump coupled to a check valve and in flow communication with said reservoir and said dispenser, said pump is a pump selected from the group consisting of a bulb actuated mechanical pump, a lever actuated mechanical pump, and a solenoid-driven electric pump.

17. A dishwasher in accordance with claim 15 wherein said reservoir further comprises a cartridge removably coupled inside said reservoir housing, said cartridge filled with a liquid selected from the group consisting of a liquid detergent and a rinse agent.

18. A dishwasher in accordance with claim 15 wherein said reservoir comprises a reservoir assembly coupled to a pump assembly, said pump assembly and said reservoir assembly positioned outside said dishwasher.

19. A dishwasher in accordance with claim 15 wherein said reservoir is filled with a liquid from the group consisting of a liquid detergent and a rinse agent.

* * * * *